US006112999A

United States Patent [19]

Fingleton et al.

[11] Patent Number: 6,112,999

[45] Date of Patent: Sep. 5, 2000

[54] POWDER PAINT SYSTEM AND CONTROL THEREOF

[75] Inventors: Patrick J. Fingleton, Grand Rapids; Eugene C. Jager, Orleans; Robert W. Meyer, West Olive, all of Mich.

[73] Assignee: Steelcase Development Inc., Grand Rapids, Mich.

[21] Appl. No.: 09/191,892

[22] Filed: Nov. 13, 1998

[51] Int. Cl.[7] ..... A62C 5/02; B05B 15/02

[52] U.S. Cl. ..... 239/8; 239/112; 239/704; 239/DIG. 14

[58] Field of Search ..... 239/112, 113, 239/690, 704, 337, 338, 1, 8, 9, DIG. 14

[56] References Cited

U.S. PATENT DOCUMENTS

| | | | |
|---|---|---|---|
| 3,672,570 | 6/1972 | Scarbrough et al. | 239/112 X |
| 3,674,205 | 7/1972 | Kock . | |
| 4,170,074 | 10/1979 | Heckman et al. . | |
| 4,248,379 | 2/1981 | Hollstein et al. . | |
| 4,302,481 | 11/1981 | Ribnitz et al. . | |
| 4,590,884 | 5/1986 | Kreeger et al. . | |
| 4,728,033 | 3/1988 | Matsumura et al. . | |
| 4,730,647 | 3/1988 | Mulder . | |
| 4,746,063 | 5/1988 | Roberts | 239/112 X |
| 4,770,344 | 9/1988 | Kaiser . | |
| 4,823,731 | 4/1989 | Howeth . | |
| 4,824,295 | 4/1989 | Sharpless . | |
| 4,898,116 | 2/1990 | Kozoe et al. . | |
| 4,953,495 | 9/1990 | Salisbury . | |
| 4,957,060 | 9/1990 | Cann . | |
| 5,018,909 | 5/1991 | Crum et al. | 406/138 |
| 5,080,289 | 1/1992 | Lunzer | 239/690 |
| 5,107,756 | 4/1992 | Diaz . | |
| 5,136,972 | 8/1992 | Naka et al. | 239/112 X |
| 5,170,591 | 12/1992 | Brielmaier et al. . | |
| 5,215,261 | 6/1993 | Frene . | |
| 5,256,201 | 10/1993 | Gelain et al. . | |
| 5,288,324 | 2/1994 | Shaneyfelt . | |
| 5,389,149 | 2/1995 | Carey et al. . | |
| 5,591,240 | 1/1997 | Ophardt et al. . | |
| 5,645,380 | 7/1997 | Rutz . | |
| 5,704,957 | 1/1998 | Rutz . | |
| 5,739,429 | 4/1998 | Schmitkons et al. | 73/196 |
| 5,776,249 | 7/1998 | Rutz . | |

OTHER PUBLICATIONS

Exhibit A discloses a prior art powder paint pump and feed hopper; manufacturer and disclosure Date Unknown.

Exhibit B discloses a prior art powder paint pump and feed hopper; manufacturer and disclosure Date Unknown.

*Primary Examiner*—Lesley D. Morris
*Assistant Examiner*—Sean P. O'Hanlon
*Attorney, Agent, or Firm*—Price, Heneveld, Cooper, DeWitt & Litton

[57] ABSTRACT

A paint system includes a plurality of supply tanks that can be selected for supplying powder paint to a spray site, each having a supply line connected to the supply tank and having an end section, a spray gun, and a purge air supply. Each end section is configured for selective connection to the spray gun to spray powder paint from the supply tank and also for connection to the purge air supply to blow residue powder paint in the supply line back into the supply tank. A control device operably connects a fluidizing air supply to each supply tank. The control device is configured to fluidize the powder paint in each tank at a low standby pressure when the supply tank is not in use, and to fluidize the powder paint in the tank at a higher operating pressure when the supply tank is selected for use. Methods related to the above cause the color change to be very efficient and quick, with low waste of powder paint.

27 Claims, 7 Drawing Sheets

POWDER PAINT SYSTEM AND CONTROL THEREOF

BACKGROUND OF THE PRESENT INVENTION

The present invention concerns a powder paint system that includes an arrangement permitting quick color change and that minimizes paint lost when making the color change.

Colored powder paint must be completely purged from a paint line and spray gun, particularly when changing from a dark color to a light color, so that residue paint from the previous color does not discolor the next color. A problem is that this leads to slow cycle times, wasted labor, and process inefficiencies. Also, existing purge methods lead to considerable waste in the form of purged material that must be landfilled, which could be very expensive, particularly if the landfilled materials are potential pollutants to the environment.

Some manufacturers have chosen to use a different paint line and spray gun for each color. However, this requires a large capital expenditure for equipment. Further, the equipment takes up space and each station requires constant maintenance and upkeep, whether or not it is used.

Another problem is that the particles of the powder paint will degrade if kept in a fluidized state ready for use over long periods of time. Powder paints must be fluidized (i.e., suspended in air or a gaseous carrier), so that a uniform and steady flow of particles of powder paint can be picked up and carried to a part upon demand. Degradation occurs because collisions between particles affect the particle surfaces and also cause the particles to become smaller in size. Where a high voltage charge is used to assist in depositing the powder paint onto a part, the degraded powder materials have a reduced ability to pick up or hold a high voltage charge.

Therefore, an apparatus and method solving the aforementioned problems and having the aforementioned advantages is needed.

SUMMARY OF THE INVENTION

In one aspect of the present invention, a paint system includes a spray gun, a supply tank including a pump configured to supply fluidized powder paint to the spray gun, a supply line connected to the supply tank and having an end section, and a purge air supply. The end section is configured for selective connection to the spray gun to spray powder paint received from the supply tank and also for connection to the purge air supply to back purge residue powder paint in the supply line back into the supply tank.

In another aspect of the present invention, a paint system includes a supply tank, an air supply for fluidizing powder paint in the supply tank, and a control device operably connecting the air supply to the supply tank. The control device is configured to fluidize the powder paint in the tank at a low standby fluidized condition when the supply tank is not in use, and to fluidize the powder paint in the tank at a higher fluidized condition when the supply tank is selected for use.

In another aspect of the present invention, a paint system includes a plurality of supply tanks, pumps, and supply lines configured to supply powder paint and having different colors. A spray gun is configured for connection to one of the supply lines. A first valving arrangement is configured to selectively fluidize each of the tanks and to operably feed powder paint to the spray gun through the supply line, and a second valving arrangement is configured to purge the supply line back to a selected one of the supply tanks when an operator is done spraying powder paint from the selected supply tank.

In yet another aspect of the present invention, a method comprises steps of providing a plurality of supply tanks having different colors of powder paint therein, each having a supply line extending therefrom. The method includes operably connecting a spray gun to a selected one of supply lines for applying powder paint from one of the supply tanks, and disconnecting the one supply line from the spray gun when finished applying the powder paint. The method further includes connecting the one supply line to a purge air source for back purging residue material in the one supply line back to the associated one supply tank.

These and other features, objects, and advantages of the present invention will become apparent to a person of ordinary skill upon reading the following description and claims together with reference to the accompanying drawings.

DETAILED DESCRIPTION OF THE PREFERRED EMBODIMENTS

Figure 1:
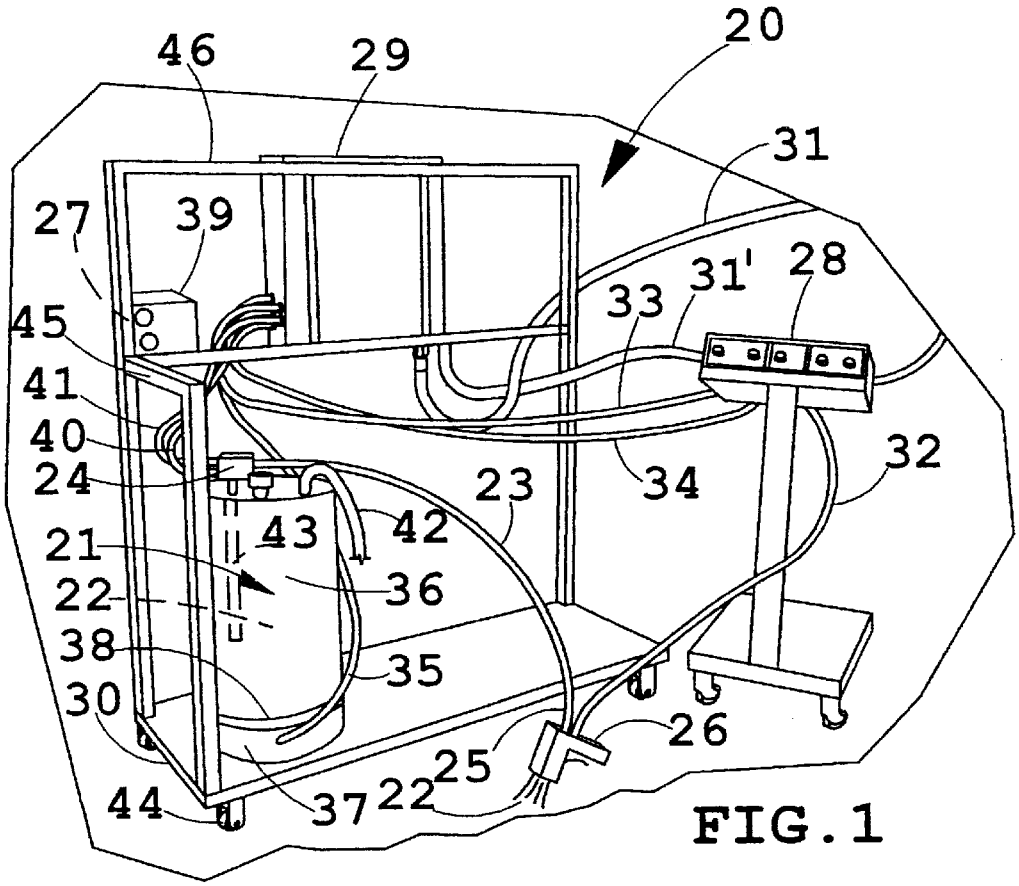
FIG. 1 is a perspective view showing a powder paint system embodying the present invention, including a single powder paint supply tank.
Figure 2:
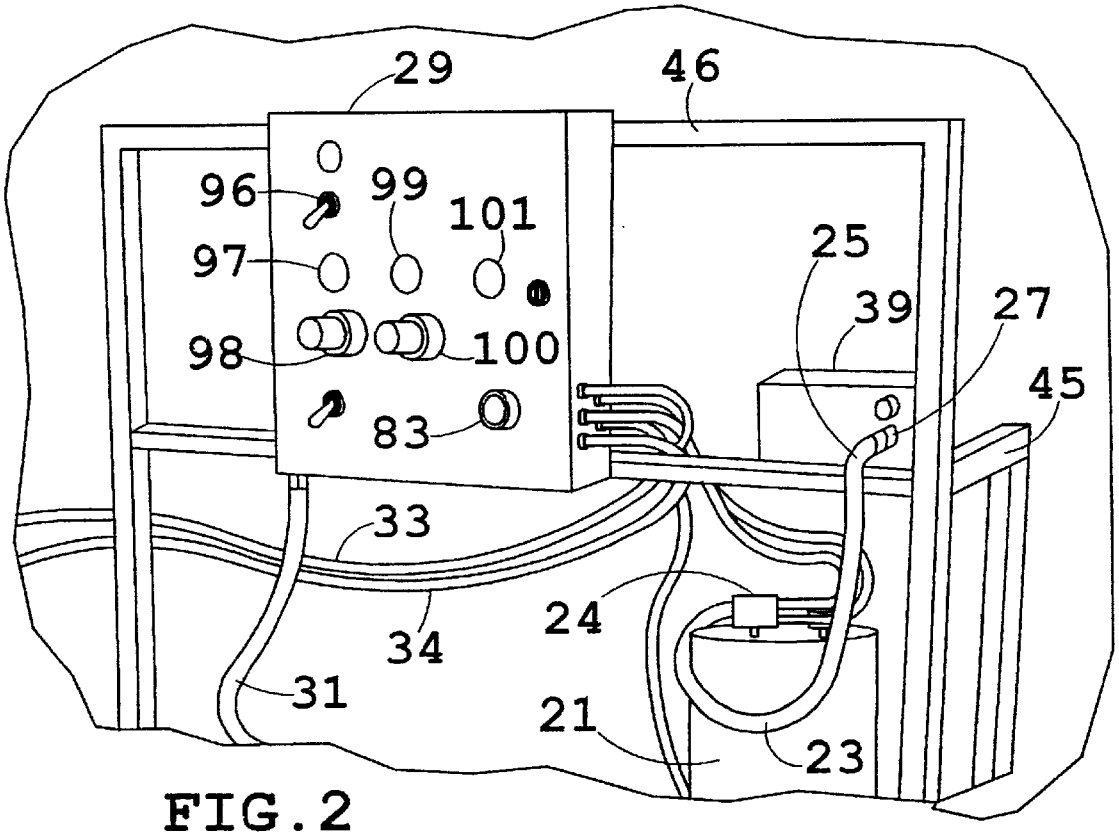
FIG. 2 is a front perspective view of the powder paint control system shown in FIG. 1.

A powder paint system 20 (FIG. 1) includes at least one powder paint supply tank 21 that can be selected for supplying powder paint 22. It is noted that a single supply tank 21 is shown in FIGS. 1–8 to facilitate describing the present invention. However, the present powder paint system is particularly adapted for use in a multi-tank system as shown in FIGS. 9–13 and described below. The paint system 20 includes a pump-to-gun paint supply line 23 that is connected to a pump 24 on the supply tank 21 at one end. The gun supply line 23 includes a second end 25 that is selectively connectable to a spray gun 26 or to a purge air supply 27, depending on the operation to be performed as described below. The illustrated paint system 20 further includes a gun box 28 for controlling electrostatic charges generated in the spray gun 26 for charging the powder paint 22 that flows through the spray gun 26 to assist in depositing the powder paint 22 on a product. A valving control box 29 is operably connected to the supply tank 21, the supply line 23, and the gun box 28 for controlling airflow within the paint system 20. Specifically, the valving control box 29 houses a first valving arrangement to control the fluidization pressures in the supply tank 21, a second valving arrangement to control powder delivery airflow and powder atomization airflow through a pump 24 on the supply tank 21 through the supply line 23 to the spray gun 26, and a third valving arrangement to control purge airflow. The illustrated powder paint system 20 is mounted on a cart 30 for easy movement, but it is contemplated that the present invention applies to stationary systems. The present invention is particularly adapted for quick color change in multi-tank systems with minimal lost powder paint.

A main air inlet 31 (FIG. 1) is fed into control box 29. Another main air feed 31' can be input from the control box 29 to the gun box 28 if desired (or from another source), such as for providing an air source to the air gun box 28. Wiring 32 extends from gun box 28 to spray gun 26. Spray guns, such as spray gun 26, electrical controls and means for controlling the electrostatic charges are known in the art, such that they do not need to be described for a complete understanding of the present invention. A powder delivery airflow first line 33 and also a powder atomizing airflow second line 34 extend from gun box 28 to valving control box 29. The first line 33 is operably connected to the first powder delivery air valving arrangement in the valving control box 29. The second line 34 is connected to the second powder atomizing valving arrangement in the valving control box 29. A powder fluidization line 35 extends from the fluidization valving arrangement in control box 29 to a bottom of the supply tank 21. The illustrated supply tank 21 is barrel shaped, optimally suited for providing a swirling fluidizing action to suspend powder paint particles. The supply tank 21 includes an upper chamber 36 for holding fluidized powder paint and a lower chamber 37 for receiving fluidization air from the fluidization line 35 that passes upwardly into the upper chamber 36. A porous filter/wall 38 separates the upper and lower chambers 36 and 37 and permits the fluidizing air to flow upwardly from the lower chamber 37 into the upper chamber 36 in a manner fluidizing the powder paint 22. This keeps the powder paint 22 suspended and dispersed, so that it is ready to be carried to the spray gun 26 for application. A powder delivery airflow line 40 and a powder atomization line 41 extend from the respective valving arrangement in control box 29 to the pump 24. The airflow line 40 provides the airflow to pump 24 necessary to provide a venturi effect to suck fluidized powder paint 22 into the air stream traveling along the supply line 23 to the spray gun 26. The atomization line 41 provides an additional volume of air that is necessary to create the total airflow desired. The atomization air lets the speed of the total airflow and also the dispersion of powder paint 22 in the total airflow to be adjusted to desired values for optimal painting. A vent line 42 extends from a top of supply tank 21 for venting excess fluidization air fed into the supply tank 21. The illustrated pump 24 includes a suction tube 43 that extends about ⅔ of the way down into the supply tank 21. Notably, although a specific supply tank is shown, it is contemplated that the present invention is broad enough to include various tank configurations and pump arrangements, and accordingly the present description of these components is intended only to facilitate an understanding of the present invention. The third valving arrangement in the valving control box 29 is connected directly to the main air supply 31 and is connected to a purge manifold 39, as described below.

The supply tank 21, the gun box 28, and the valving control box 29 are supported on a cart 30. The cart 30 (FIG. 1) includes wheels 44, a handle 45, and a standard 46 with brackets for attaching the valving control box 29 and the purge manifold 39. It is contemplated that other means of movement can also be used, such as a pallet like carrier platform engageable by a fork truck or a pull-trailer having a hitch. As noted above, the system can also be made stationary.

The first valving arrangement (FIG. 3) for fluidizing the powder paint in the supply tank 21 includes an air supply line 47 extending from the operating airflow first line 31 to an air pressure regulator 48 for regulating a low standby pressure, such as about 5 psi. An air line 49 extends from the regulator 48 to a first inlet 50' in a shuttle check valve 50. The shuttle check valve 50 includes a ball check 51 that is movable to a first position (FIG. 3) allowing air to flow into the first inlet 50' through the shuttle check valve 50 to an outlet 52. The ball check 51 is also movable to a second position (FIG. 4) that prevents back flow into the standby pressure air line 49. The outlet 52 is connected to the fluidization line 35 for fluidizing the supply tank 21 at a low standby fluidization pressure. The standby fluidization pressure is adjusted by regulator 48 to a minimum pressure condition to minimize particle degradation over time, but so that the particles of powder paint 22 are sufficiently suspended to prevent agglomeration and to allow a quick increase to the operational airflow/pressure without undue delay.

Figure 3:
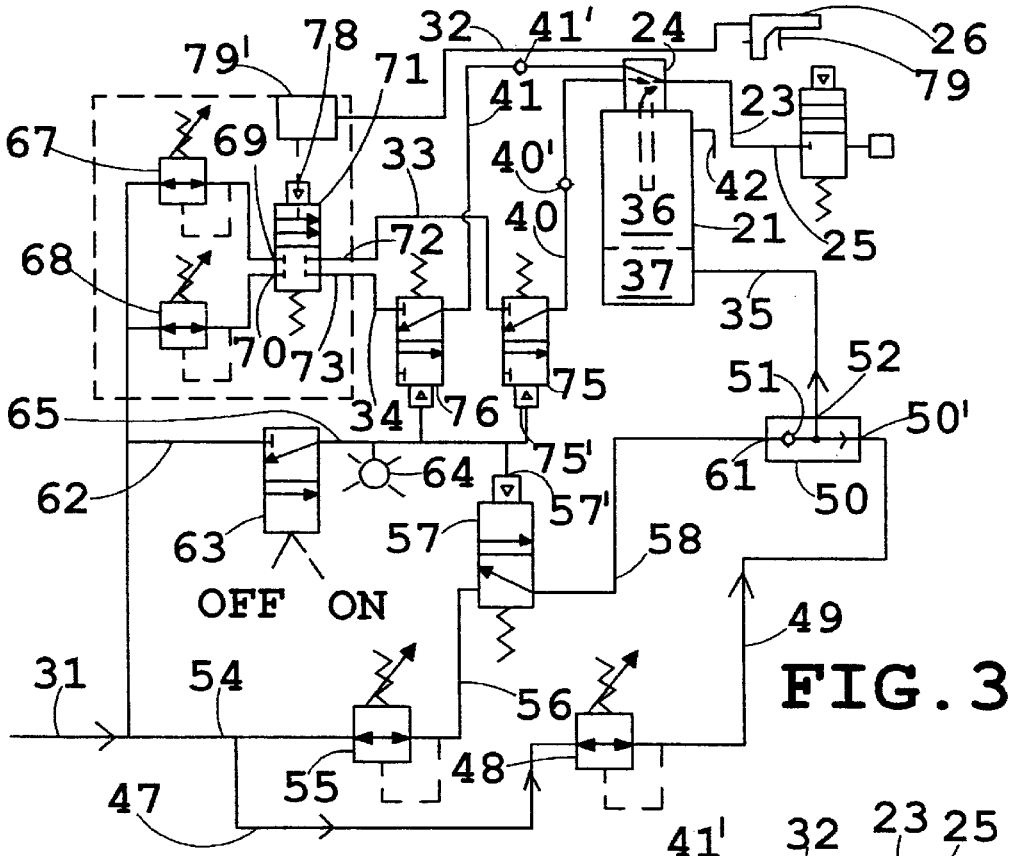
FIGS. 3–6 are schematic views showing the valving, connecting lines, and components for the powder fluidizing airflow, the powder delivery airflow, the powder atomizing airflow, and the powder purge airflow, FIG. 3 being in a standby state, FIG. 4 being in an operating state before use (i.e., with the spray gun turned off), FIG. 5 being in an operational state and in use, and FIG. 6 showing the purge airflow.

A second air supply line 54 extends from the first line 31 to a second air pressure regulator 55 for controlling the operating fluidization pressure in the supply tank 21, such as about 10 psi. An air line 56 extends from the second air pressure regulator 55 to an inlet side of an air valve 57 for controlling the fluidizing pressure in supply tank 21. An air line 58 extends from an outlet of the air valve 57 to a second inlet 61 on the shuttle check valve 50. The ball check 51 is configured to allow flow through its outlet when the ball check 51 is in the second position (FIG. 4), but to prevent back flow into the second inlet when the ball check 51 is in the first position (FIG. 3).

Figure 4:
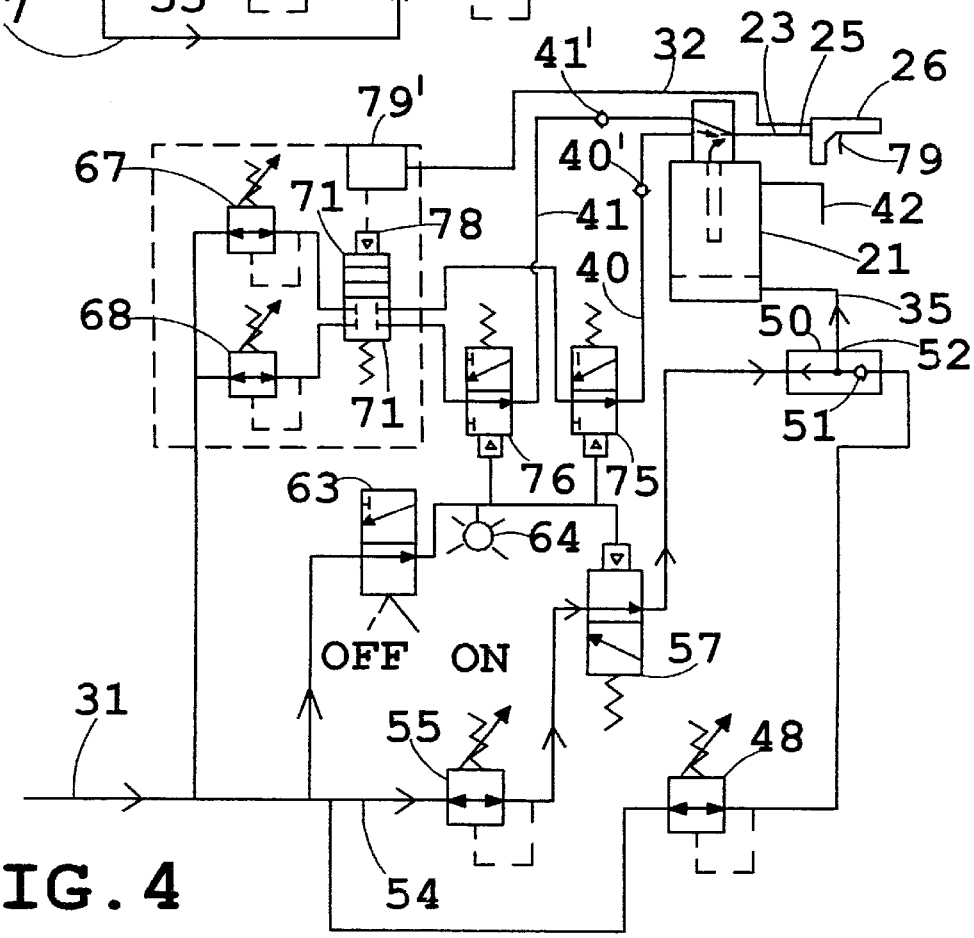

The first valving arrangement includes a control device for controlling which regulator 48 or 55 is being operated to control the fluidizing airflow of the supply tank 21. This control device includes a third air supply line 62 that extends from the main air line 31 to an on/off valve 63. An "on" wink indicator 64 is connected to an outlet of the on/off valve 63 for indicating when the on/off valve 63 is operational. An air line 65 extends from an outlet on the on/off valve 63 to a control port 57' on the air valve 57. When the valve 63 is on, air flows to the control port 57'. This moves the spool of the air valve 57 to a position allowing air from the regulator 55 to pass through the air valve 57 to the shuttle check valve 50. This air causes the ball check 51 of the shuttle check valve 50 to move from the first position to the second position. By this method, the fluidizing airflow/pressure in the supply tank 21 is changed from a standby condition (FIG. 3) to an operating condition (FIG. 4). In the operating condition, the particles of the powder paint 22 are excited to a higher state, such that they are optimally suspended to be drawn into the airflow traveling through the supply line 23 to the spray gun 26 for application to a part. For example, this fluidization pressure may be about double the standby fluidization pressure. It is noted that the standby and operational fluidization pressures are very dependent upon the length and size of hoses and the supply lines, the input main air pressure, the equipment, the powder paint 22, and the components used in the overall system 20.

The main air inlet 31 (FIG. 3) is connected to first and second regulators 67 and 68, which are in turn connected to a pair of first and second inlets 69 and 70 on an air-to-gun control valve 71 located in the gun box 28. First and second air lines 72 and 73 extend from outlets on the control valve 71 and are connected to the flow lines 33 and 34, respectively. The powder delivery airflow line 40 is connected to an outlet of a fluidization control valve 75, and an outlet of the fluidization control valve 75 is connected to the pump 24 by airflow line 40. The powder atomization flow line 34 is connected to an inlet of an atomization control valve 76, and an outlet of the atomization control valve 76 is connected to the pump 24 by airflow line 41. Check valves 40' and 41' prevent undesired back flow in lines 40 and 41, respectively. The outlet of pump 24 is connected to a first end of the supply line 23. The pump 24 normally sits on top of the supply tank 21, although it could be located in or beside the tank. The control valves 75 and 76 include control ports 75' and 76' connected to air line 65, such that the control valves 75 and 76 are opened when the valve 63 is turned on. This prevents the pump 24 from being operated when a different color is selected.

The air-to-gun control valve 71 (FIG. 4) includes a solenoid 78 electrically connected to a trigger 79 on the spray gun 26 by the wiring 32 and electrical control box 79'. By actuating the trigger 79, the valves are shifted so that fluidization air and also atomization air are simultaneously supplied to the pump 24, through supply line 23 to the spray gun 26 (see FIG. 5). Operators typically spray the powder paint 22 relatively continuously, so that the airflow and paint application process is relatively constant. Nonetheless, the trigger allows operators to control air flow and paint flow at the point of application.

Figure 5:
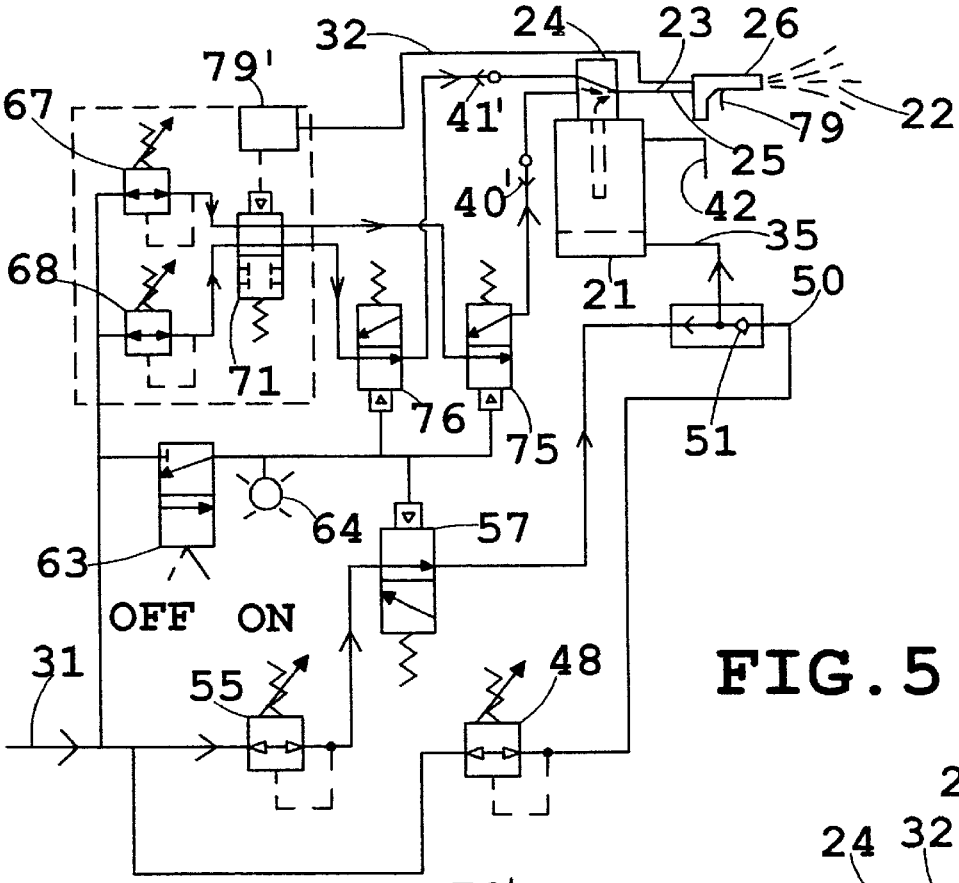
Figure 6:
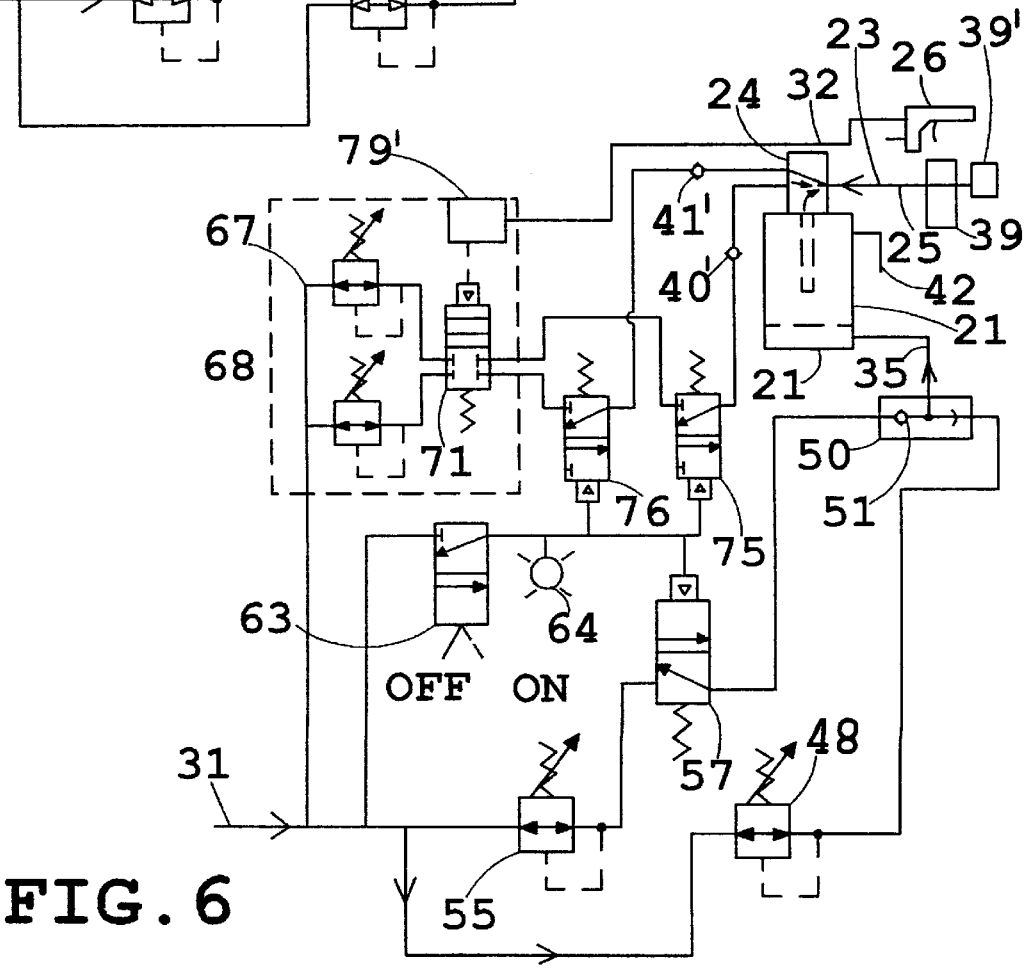
Figure 7:
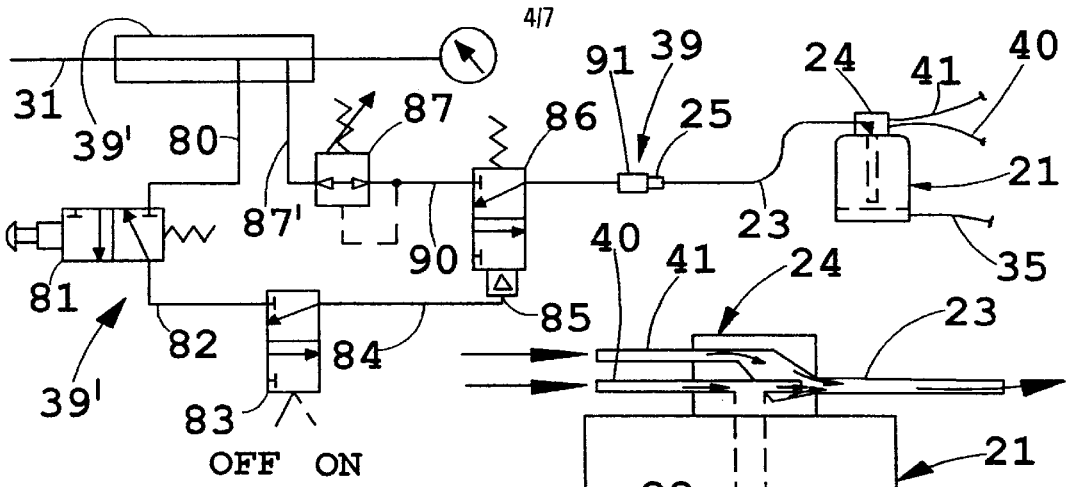
FIG. 7 is a schematic view showing valving for the purge airflow.
Figure 8:
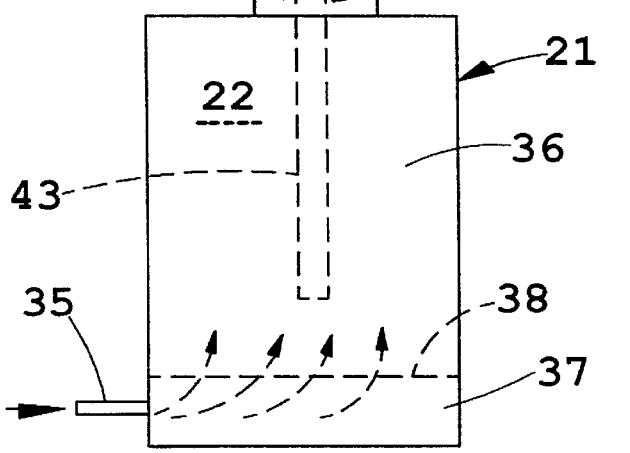
FIG. 8 is an elevational side cross-sectional schematic view of the fluidization tank shown in FIG. 1.
Figure 10:
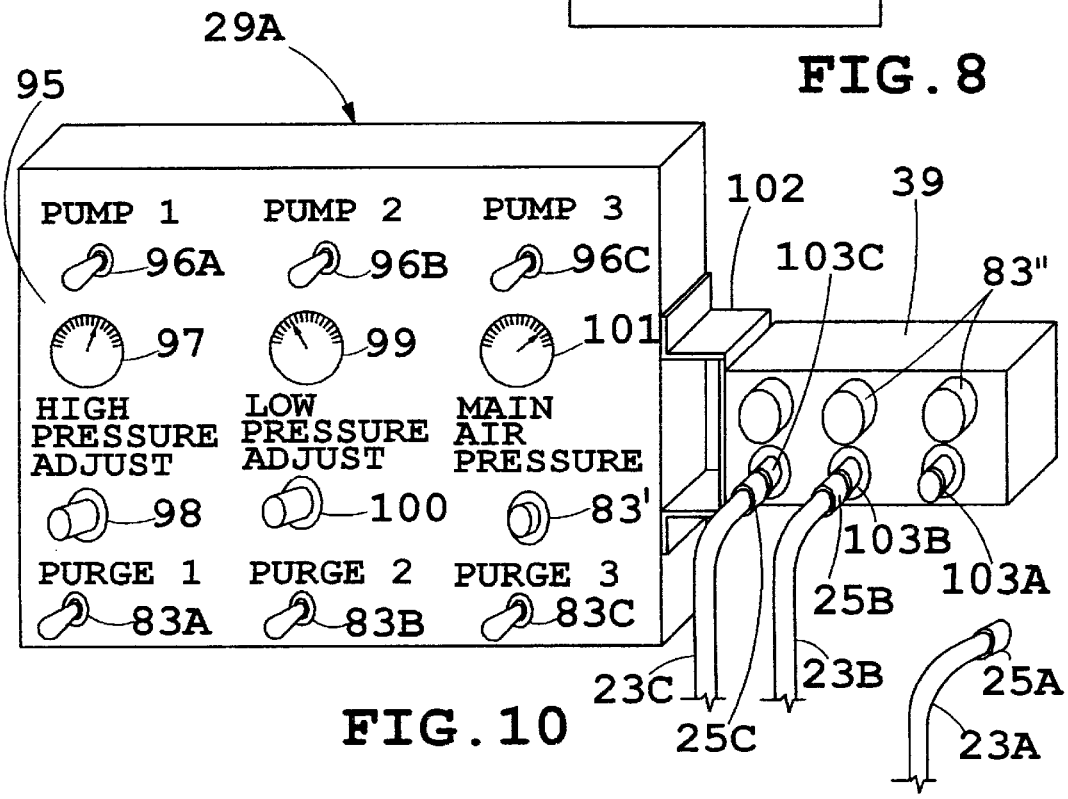
FIG. 10 is a perspective view of the control panel for the modified powder paint system shown in FIG. 9.
Figure 9:
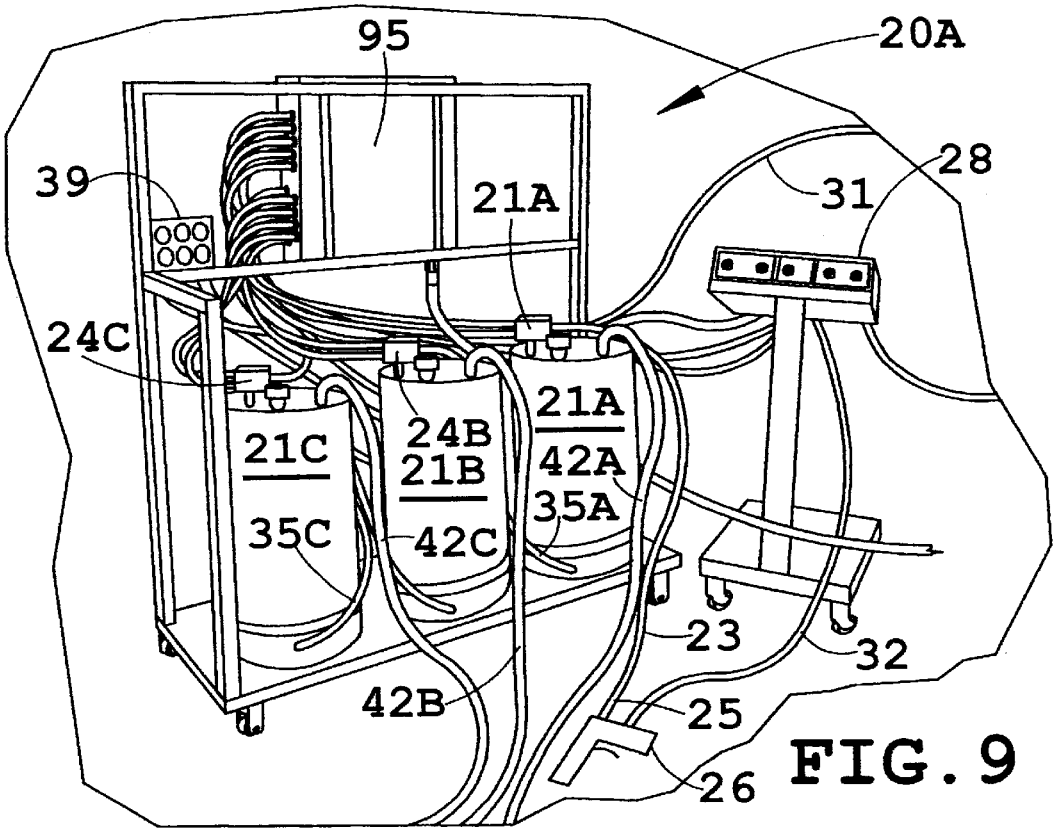
FIG. 9 is a perspective view showing a modified powder paint system embodying the present invention, including multiple powder supply tanks.
Figure 9A:
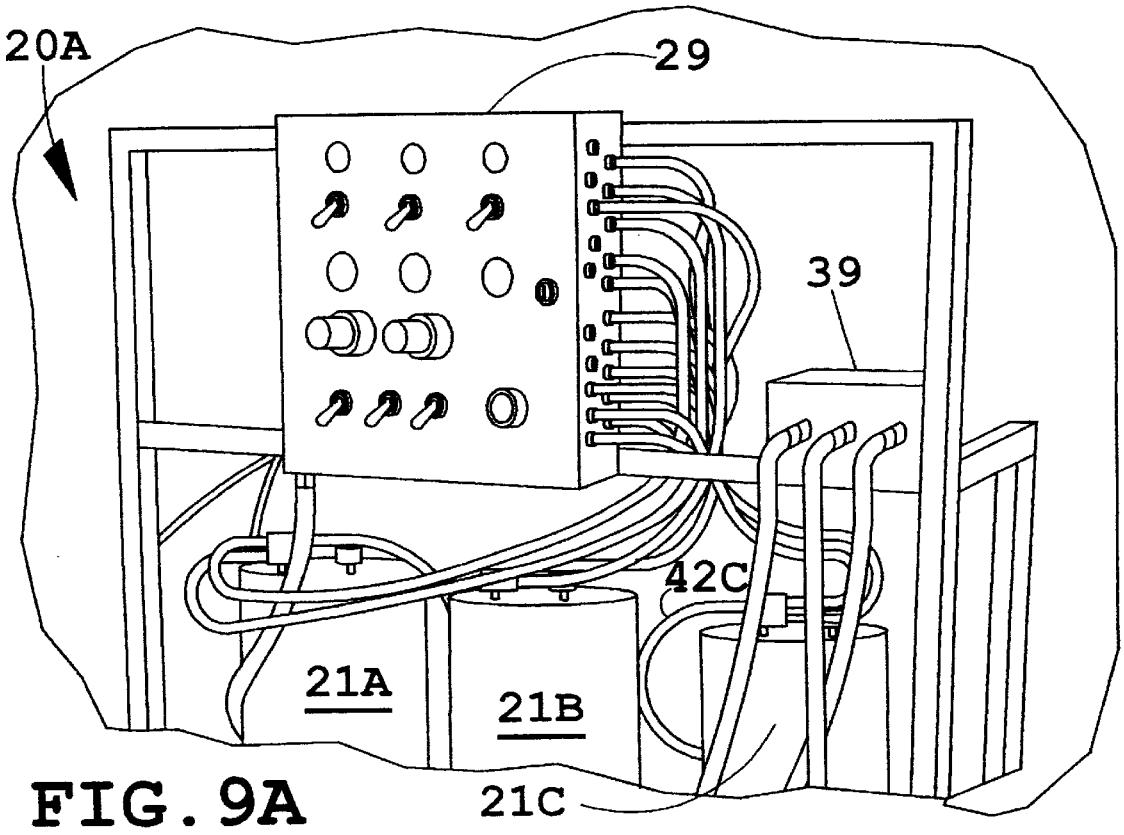
FIG. 9A is a front perspective view of the powder paint control system shown in FIG. 9.

In the standby condition (FIG. 3), the supply line 23 is not normally connected to the spray gun 26. At such time that an operator wants to spray the color of powder paint 22 in the supply tank 21, the operator switches the valve 63 to an on position (FIG. 4) and also connects the free end 25 of the supply line 23 to the spray gun 26. Powder paint 22 is then sprayed as the trigger is pressed (FIG. 5). When done, the operator turns off the valve 63, disconnects the free end 25 of the gun supply line 23, and plugs the free end 25 into a purge manifold 39 operably connected to the purge control valves 39' (FIG. 6). With the valve 63 in the off position, the supply tank 21 returns to a standby lower airflow/pressure to minimize degradation of the powder paint in the supply tank 21.

The third valving arrangement in the valving control box 29 (FIG. 7) for powder purge includes the air distribution manifold 39', which is connected to the main air inlet 31 at an inlet port. An outlet to the air distribution manifold 39' is connected by air line 80 to a pushbutton operated valve 81. An outlet on pushbutton operated valve 81 is connected by air line 82 to a purge on/off valve 83. A push button 83' (FIG. 10) operates the purge on/off valve 83 and light indicators 83" indicate whether a system is purging. An outlet of purge on/off valve 83 is connected by line 84 to a control port 85 on a main purge valve 86. The air distribution manifold 39' is connected by line 87' to a regulator 87, which in turn is connected by an air line 90 directly to an inlet on the main purge valve 86. An outlet of the main purge valve 86 is connected by air line 90 to a purge nipple 91 supported in an easily accessible position on an outside of the valving control box 29. The check valve on air line 90 prevents powder contamination. The purge nipple 91 is configured for quick slip connection to the free end 25 of the supply line 23. The pushbutton valve 83 is actuable to provide a controlled pulse of high pressure air to back flush any residue powder paint left in the supply line 23 back through the pump 24 into the supply tank 21. Since the fluidization and atomization control valves 75 and 76 are closed, the back purged air carries the residue powder paint in the supply line 23 through the venturi pump 24 back into the upper chamber 36 of the supply tank 21. Check valves on lines 40 and 41 prevent powder contamination. The regulator 87 is set at a sufficient pressure to provide the pulse needed to back purge the gun supply line 23. It is contemplated that the pushbutton valve 81 can be of the type that automatically provides a timed pulse of purge air, or alternatively that a timer (not specifically shown) can be inserted in addition to the pushbutton valve 81. It is also contemplated that the valving arrangement can be electrically or electro-pneumatically controlled such as with a programmable controller.

Having described a system 20 that includes a single supply tank 21, the modified powder paint system 20A shown in FIGS. 9–13 will be readily understood by a person of ordinary skill in this art. To avoid repetitious and redundant discussion, the system 20A will be described by using identical numbers for identical or similar features and components, but with the addition of the letters "A," "B," and "C" to each color in the modified system. Three such colors are shown, but it is to be understood that the system can easily be expanded to add additional supply tanks or additional spray guns, including multiple spray guns for spraying from a single tank at the same time or for spraying from different tanks simultaneously.

The system 20A includes multiple supply tanks 21A–21C and an appropriate number of lines extending between the gun box 28, the valving control box 29, the supply tanks 21A–21C, and the purge manifold 39. A single spray gun 26 is shown.

Figure 11:
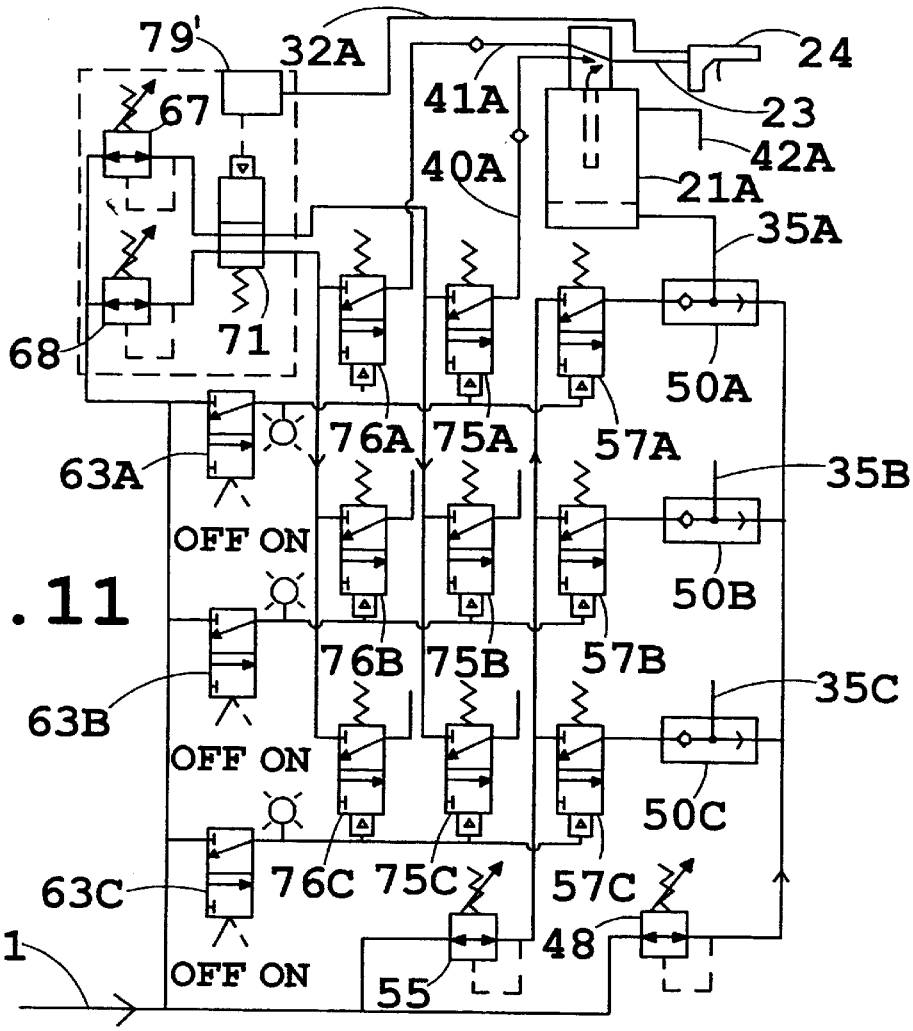
FIG. 11 is a schematic view of the valving arrangement and airflow lines of the powder paint system shown in FIG. 9, including the specific valving, connecting lines, and components needed for multiple tank operation.
Figure 12:
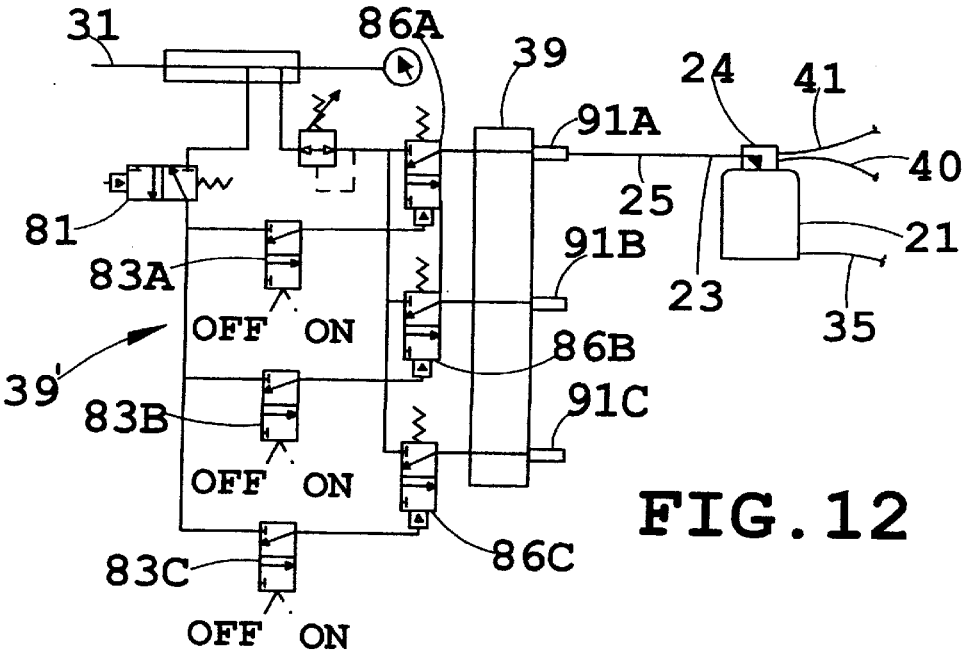
FIG. 12 is a schematic view of the purging system for the powder paint system of FIG. 9.

The system 20A includes a control panel face 95 (FIG. 10) having switches 96A–96C for actuating each of the on/off valves 63A–63C (FIG. 11). A first pressure gage 97 (FIG. 10) and adjustment knob 98 are provided for measuring and adjusting the operating fluidization pressure being applied to fluidize the selected supply tank 21A from fluidizing line 35A. A second pressure gage 99 and adjustment knob 100 are provided for measuring and adjusting the standby fluidization pressure being applied to fluidize the de-selected supply tanks 21B and 21C. A third pressure gage 101 is provided for measuring the input air pressure from main air line 31 to the valving control box 29A. Switches 83A–83C are provided for actuating the purge sequence to purge a de-selected gun supply line 23B that was recently plugged into the purge manifold 39. The purge manifold 39 is mounted with bracketry 102 to a side of the valving control box 29A. The purge manifold 39 includes a plurality of purge nipples 103A–103C for receiving the free end 25A–25C, respectively. The plurality of purge nipples 103A–103C serve to both totally separate each color from another, and further serve as a docking station for the free ends 25A–25C until the colors are selected again. It is noted that additional features and components can be added to the control panel 95 and/or to the valving control box 29A. For example, these items include automatic timers, sensors for sensing the presence of the free ends 25A–25C on the purge manifold, sensors for sensing the presence of additional spray guns 26, sensors for sensing low levels of powder paint 22 in the supply tanks, automatic tank refillers, automatic changers for connecting and disconnecting the free ends 25A–25C to the spray gun and to the purge manifold, and etc.

Figure 13:
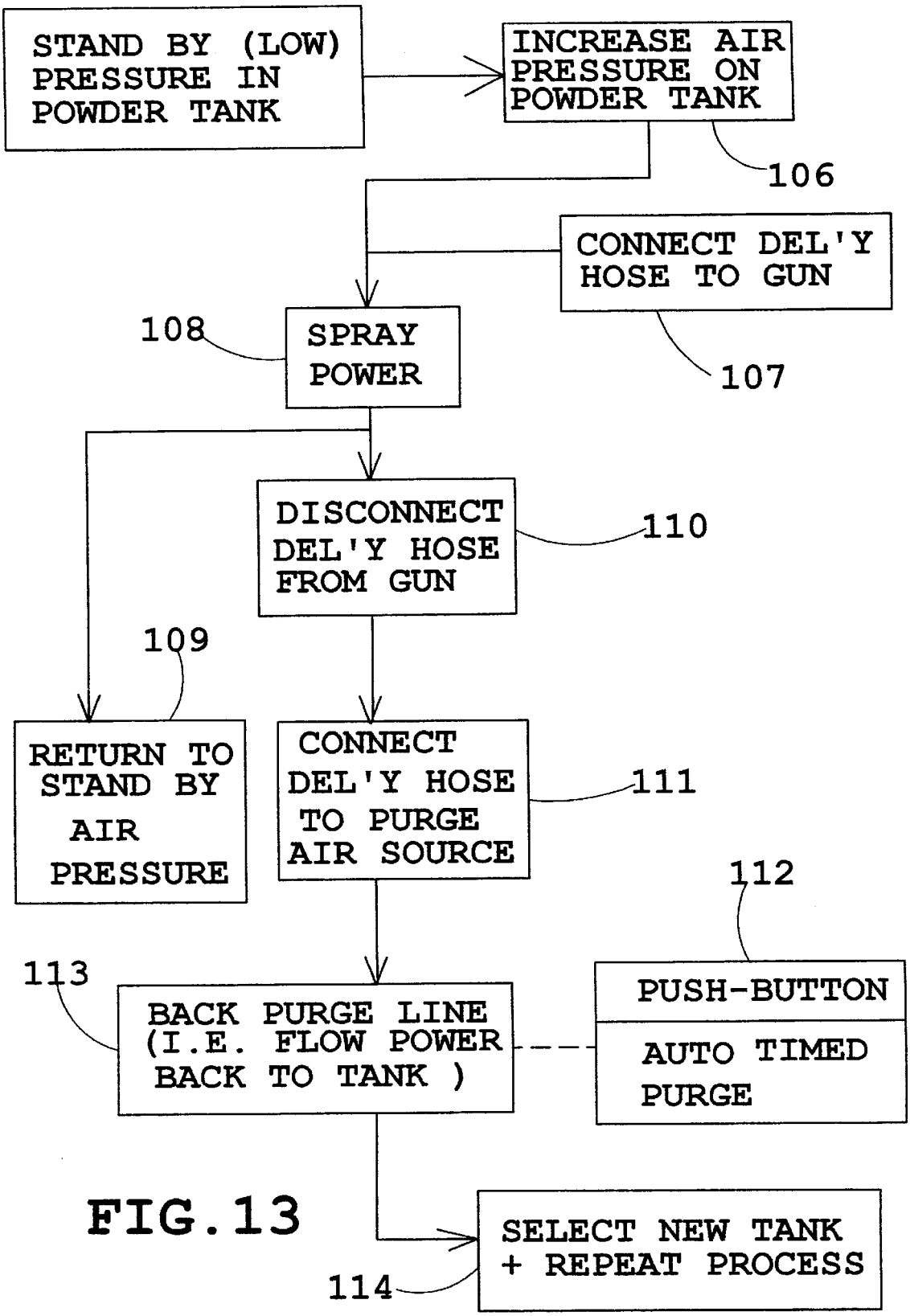
FIG. 13 is a flow diagram of the method of color change of the present invention.

Having described the components and their interrelationship, the operation and method of the present systems will be readily apparent to a person of ordinary skill in powder painting systems. With the system being provided as described above and ready for operation, the operator in step 106 (FIG. 13) flips the on/off switch 96A for actuating (FIG. 10) on/off valve 63A (FIG. 11) to bring the fluidization airflow/pressure in supply tank 21A up to an operating pressure. The operator also connects the free end 25A to the spray gun 26 in a step 107 (FIG. 13). The operator then commences to powdercoat a part by pressing the trigger 79 (step 108), which causes air to flow through pump 24A (FIG. 9) and gun supply line 23 out the spray gun 26 onto the part. When done, the operator releases the trigger 79, causing the airflow to stop and causing residue powder paint 22 to settle in the supply line 23. The operator then presses the on/off switch 63A (step 109) in a manner de-selecting that color, and simultaneously unplugs the free end 25 from the spray gun 26 (step 110) and plugs it into an appropriate nipple 103A (FIG. 10) on the purge manifold 39 (step 111) (FIG. 13). The operator selects the purge on/off switch 83A (FIG. 10) and presses push button 83' (step 112) causing the residue powder paint 22 in the supply line 23A to be blown back into the supply tank 21A (step 113). At the same time, the operator takes a new supply line 23B, attaches it to the spray gun 26, hits the on/off switch 63B for the new color, and begins painting (step 114). Testing has shown that, where the previous methods of color changes could take several minutes and more than one person, the method of the present invention can take less than 30 seconds (and even as low as 17 seconds) while using only a single operator.

In the foregoing description, it will be readily appreciated by persons skilled in the art that modifications may be made to the invention without departing from the concepts disclosed herein. For example, it is contemplated that the pneumatic control of the valving could be done by an electronic control or electro-pneumatic device. Such modifications are to be considered as included in the following claims, unless these claims by their language expressly state otherwise.

The invention claimed is:

1. A paint system comprising:

a spray gun;

a supply tank including a pump configured to supply fluidized powder paint to the spray gun;

a supply line connected to the supply tank and having an end section; and a purge air supply, the end section being configured for selective connection to the spray gun to spray powder paint from the supply tank and also for connection to the purge air supply to back purge residue powder paint in the supply line back into the supply tank.

2. The paint system defined in claim 1 including a plurality of supply tanks, each including a supply line associated therewith, the plurality of supply tanks including the first-mentioned supply tank.

3. The paint system defined in claim 1 wherein the purge air supply includes a purge manifold having a nipple shaped to slip attach to the end section of the supply line.

4. The paint system defined in claim 1 wherein the purge air supply includes a pulse-controlling device for controlling a timed pulse of high pressure air to back purge the supply line.

5. The paint system defined in claim 1 wherein the purge air supply includes a pushbutton valve for providing a pulse of high pressure air to back purge the supply line.

6. The paint system defined in claim 1 including a valving arrangement connected to the supply tank, the valving arrangement including a first regulator constructed to hold the supply tank in a lower standby fluidized condition and including a second regulator constructed to hold the supply tank at a higher operational fluidized condition.

7. The paint system defined in claim 6 wherein the standby fluidized condition is less than about half the fluidized pressure of the high fluidized condition.

8. The paint system defined in claim 6 including a shuttle check valve operably connected to the first and second regulators, and wherein the first regulator operates mutually exclusively from the second regulator, the shuttle check valve preventing back flow into the one regulator that is not supplying fluidizing air to the supply tank.

9. The paint system defined in claim 6 including a main air supply, a gun box for controlling flow of air to the supply line that includes a gun-trigger operated valve connected to the main air supply, a valving control box that includes a switch operated valve connected to the gun-trigger operated valve, the switch operated valve being further connected to at least one of the regulators.

10. The paint system defined in claim 1 including a purge air manifold and a mobile cart, the supply tank and purge air manifold being mounted on the mobile cart.

11. A paint system comprising:

a supply tank;

an air supply for fluidizing powder paint in the supply tank; and a control device operably connecting the air supply to the supply tank, the control device being configured to fluidize the powder paint in the tank at a low standby fluidized condition when the supply tank is not in use, and to fluidize the powder paint in the tank at a higher operating fluidized condition when the supply tank is selected for use.

12. The paint system defined in claim 11 including a plurality of supply tanks, each including a supply line associated therewith, the plurality of supply tanks including the first-mentioned supply tank.

13. The paint system defined in claim 12 including a purge air supply that includes a purge manifold having a nipple shaped to slip attach to end sections of the supply lines.

14. The paint system defined in claim 13 wherein the purge air supply includes a pulse-controlling device for controlling a timed pulse of high pressure air to back purge the supply line.

15. The paint system defined in claim 13 wherein the purge air supply includes a pushbutton valve for providing a pulse of high pressure air to back purge the supply line.

16. The paint system defined in claim 11 wherein the control device includes a valving arrangement connected to the supply tank, the valving arrangement including a first regulator constructed to hold the supply tank in the low standby fluidized condition and including a second regulator constructed to hold the supply tank at a higher operational fluidized condition.

17. The paint system defined in claim 16 wherein the standby fluidized condition is less than about half the fluidized pressure of the high fluidized condition.

18. The paint system defined in claim 16 including a shuttle check valve operably connected to the first and second regulators, and wherein the first regulator operates mutually exclusively from the second regulator, the shuttle check valve preventing back flow into the one regulator that is not supplying fluidizing air to the supply tank.

19. The paint system defined in claim 16 including a gun box controlling flow of air to the supply line that includes a gun-trigger operated valve connected to the air supply, a valving control box that includes a switch operated valve connected to the gun-trigger operated valve, the switch operated valve being further connected to at least one of the regulators.

20. A paint system comprising:

a plurality of supply tanks, pumps, and supply lines configured to supply powder paint of different colors;

a spray gun configured for connection to one of the supply lines;

a first valving arrangement connected to the plurality of supply tanks and configured to selectively fluidize each of the tanks and to operably feed powder paint to the spray gun through the supply line; and a second valving arrangement configured to purge the supply line back to a selected one of the supply tanks when an operator is done spraying powder paint from the selected supply tank.

21. The paint system defined in claim 20 wherein the first valving arrangement includes a first regulator constructed to hold the supply tank in the low standby fluidized condition and including a second regulator constructed to hold the supply tank at a higher operational fluidized condition.

22. The paint system defined in claim 21 wherein the standby fluidized condition is less than about half the fluidized pressure of the high fluidized condition.

23. The paint system defined in claim 21 including a shuttle check valve operably connected to the first and second regulators, and wherein the first regulator operates mutually exclusively from the second regulator, the shuttle check valve preventing back flow into the one regulator that is not supplying fluidizing air to the supply tank.

24. The paint system defined in claim 21 including a gun box controlling flow of air to the supply line, the gun box including a gun-trigger operated valve connected to the air supply, a valving control box that includes a switch operated valve connected to the gun-trigger operated valve, the switch operated valve being further connected to at least one of the regulators.

25. A method comprising steps of:

providing a plurality of supply tanks having different colors of powder paint therein, each having a supply line extending therefrom;

operably connecting a spray gun to a selected one of supply lines for applying powder paint from one of the supply tanks; and disconnecting the one supply line from the spray gun when finished applying the powder paint and connecting the one supply line to a purge air source for back purging residue material in the one supply line back to the associated one supply tank.

26. The method defined in claim 25 including connecting the spray gun to another one of the supply lines of another one of the plurality of supply tanks, and simultaneously back purging while connecting to next supply line.

27. The method defined in claim 25 including maintaining the tanks not in use at a low standby fluidized condition which is less than a high in-use fluidized condition.

* * * * *